United States Patent [19]

Ijidakinro

[11] Patent Number: 4,620,706

[45] Date of Patent: Nov. 4, 1986

[54] GAME WITH ROTATING TARGET

[76] Inventor: Olubunmi C. Ijidakinro, 1441 E. Ironwood Dr., Chandler, Ariz. 85225

[21] Appl. No.: 784,268

[22] Filed: Oct. 4, 1985

[51] Int. Cl.[4] ..... A63D 3/02; A63B 71/00; A63F 7/22

[52] U.S. Cl. ..... 273/122 R; 273/127 R

[58] Field of Search ..... 273/119 A, 119 R, 122 R, 273/122 A, 127 R, 127 C, 366, 368, 369, 142 G

[56] References Cited

U.S. PATENT DOCUMENTS 1,138,865 5/1915 Hagerty ..... 273/142 G 3,927,884 12/1975 Glass et al. ..... 273/119 R

*Primary Examiner*—Richard C. Pinkham

*Assistant Examiner*—Gary Jackson

*Attorney, Agent, or Firm*—Richard R. Mybeck

[57] ABSTRACT

An amusement device which includes a base structure having a playing surface over which ball may be shot at rotating target objects rendered intermittantly out-of-sight by the co-action of a plurality of rotating obstacles operatively interposed between the shooter and the target objects. Means are provided for collecting and separating spent shooters from dislodged target object and returning each to their respective starting position for subsequent games and for selectively rotating the targets and the obstacles.

17 Claims, 8 Drawing Figures

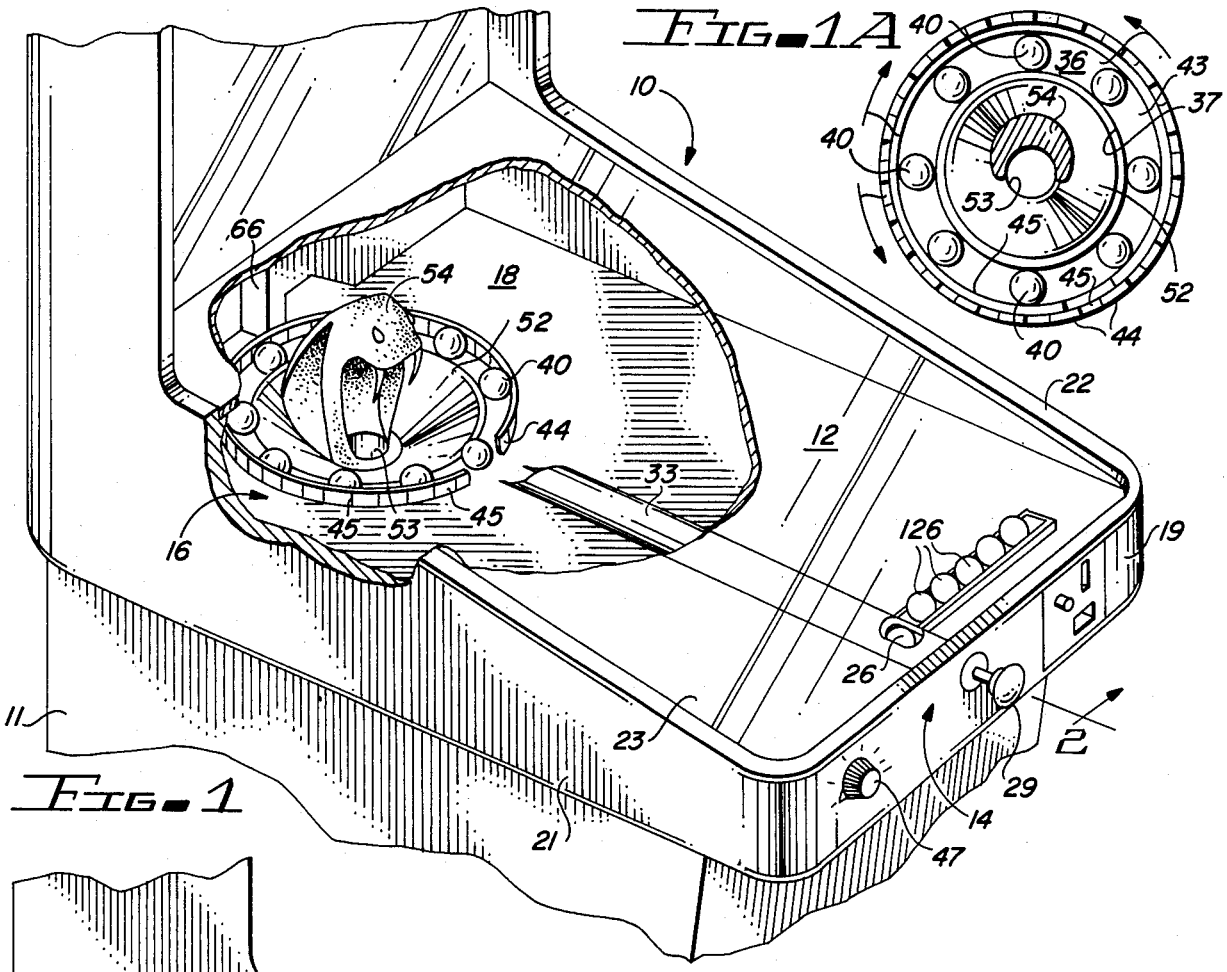
FIG. 1
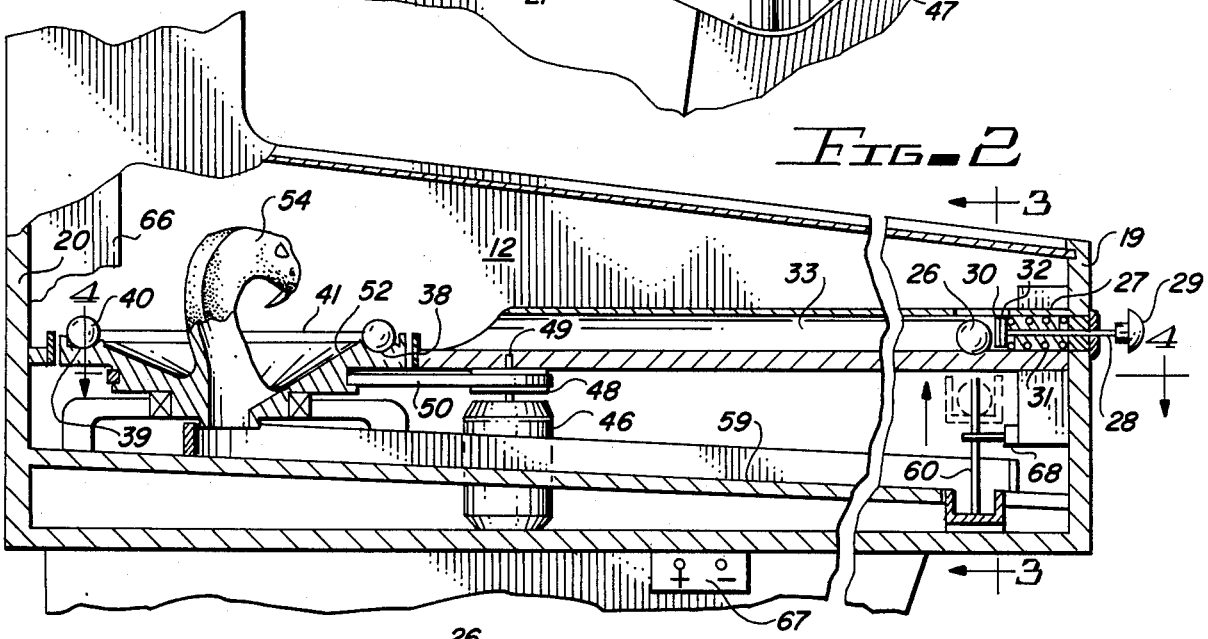
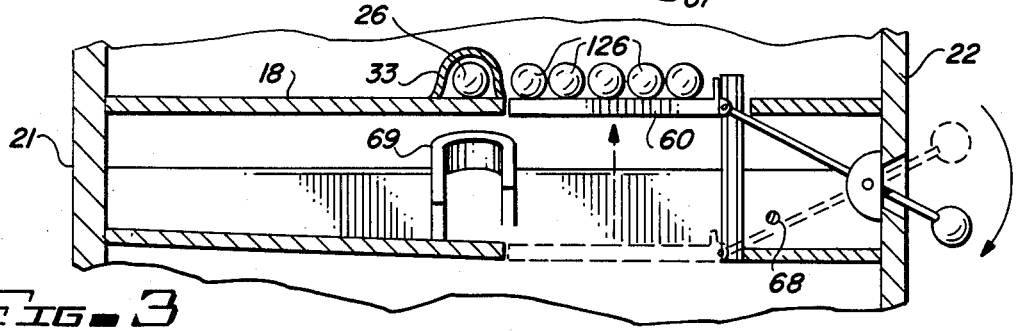
FIG. 3

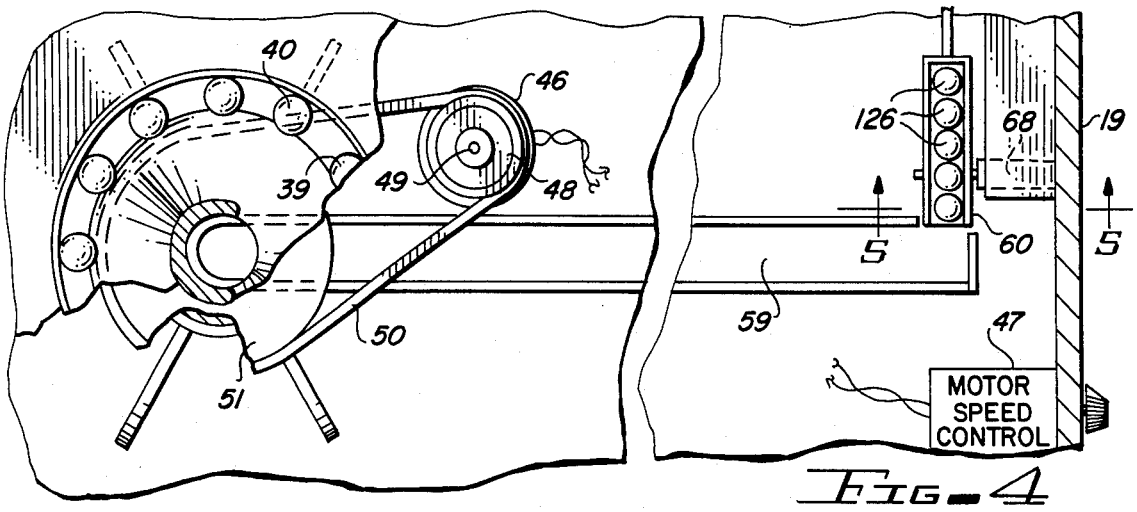
FIG. 4
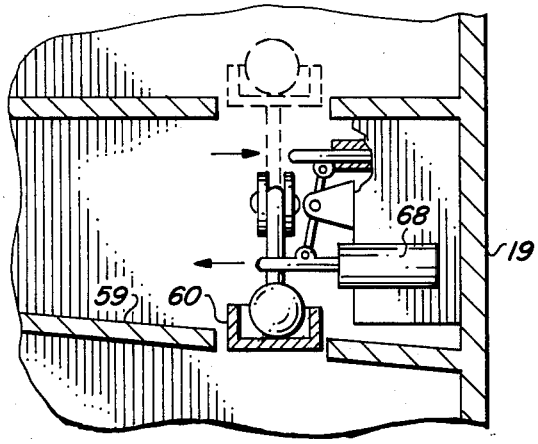
FIG. 5
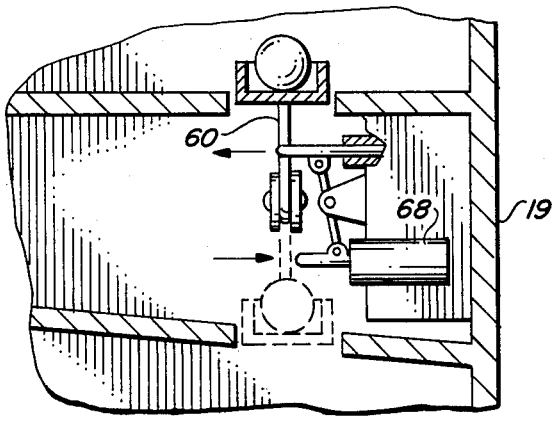
FIG. 6
FIG. 7
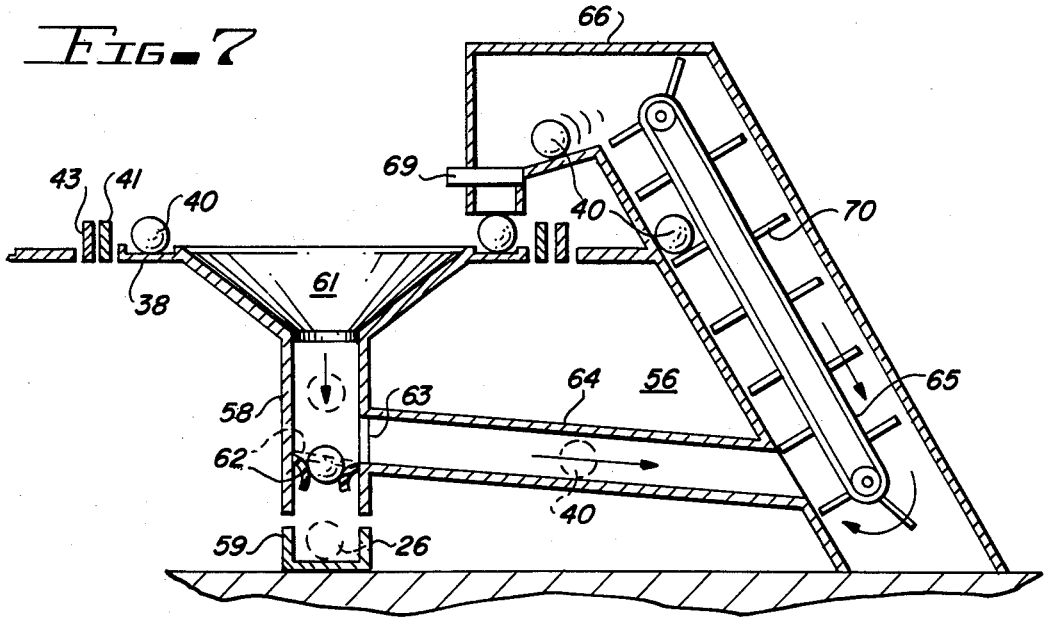

GAME WITH ROTATING TARGET

INTRODUCTION

The present invention relates to an amusement device and more particularly to a device designed to challenge the hand eye coordination of an operator who propels a contained shooter ball at one of a plurality of intermittently visible moving targets for the purpose of dislodging the target ball into the scoring area. Successful competition can be measured by the number of strikes obtained with a set number of shots or within a given time period.

BACKGROUND OF THE INVENTION

Table top amusement devices have long been a popular diversion for individuals having discretionary time. Many such games have included marble shooting devices which created scoring points either by hitting pin, or bumpers, or specially designated targets. Some of the early shooter games even included a single mechanism for shooting at one of a plurality of moving targets (see: Hagerty, U.S. Pat. No. 1,138,865 and Glass, U.S. Pat. No. 3,927,884). Many of these devices enjoyed immense popularity as a recreational pastime prior to the advent of the video game craze which essentially caused the amusement arcades to be filled with electronic devices.

Now, with the onset of "Pac-man elbow" and the advent of general video ennui, mechanical amusement devices have been rediscovered although a need exists to provide such games with new concepts and novel challenges. The present invention is directed to providing an alternative to the electronic game saturation with an essentially mechanical device which embodies new concepts and challenges to titilate the player and inspire him to perfecting his motor skills.

SUMMARY OF THE INVENTION

The present invention relates to an amusement device and more particularly to a game involving shooting a ball or marble at periodically visible rotating targets in an attempt to dislodge a target from its initial position into a scoring position. Each device includes means for propelling the shooter ball from its at rest position toward the moving target; means for collecting the shooter ball and returning it to a first locked loaded container; first conveyor means for directing said shooter ball from its locked loaded container to its at rest position; first rotating means having a plurality of seats defined thereupon for receiving the target in an initial static position relative to said rotating means for rotation therewith; means controlling the direction and speed of said first rotating means; second rotating means disposed in rotatable circumscription about said first rotating means and carrying a plurality of randomly spaced barriers adjacent the periphery thereof; means controlling the direction and speed of said second rotating means to vary the periodic visibility of said target balls from the shooter's vantage point; means for collecting dislodged target objects and conveying them to a second locked loading container; second conveyor means for directing each target object from said second loading container to a static position on said first rotating means; and actuator means responsive to a deliberate external act to unlock said locked loading container and permit the passage of said target objects to said second conveyor means and said shooter ball to said first conveyor means to place said device in playing condition. In practice, one of said loading containers may have the lock omitted therefrom.

Accordingly, it is a principal object of the present invention to provide a new and improved amusement device which is easily understood and convenient to operate and provides recreation for individuals of a broad age span, irrespective of gender.

Another object of the present invention is to provide a challenging amusement device which tests an operator's hand-to-eye coordination by requiring a shooter ball to strike an intermittently visible revolving target object in order to achieve a score.

A further object of the present invention is to provide a new and improved amusement device in which the operator can vary and control the speed at which targets and the obstacles thereto rotate and thereby establish the scoring range in which the device is operated.

Still a further object of the present invention is to provide a practical demonstration of physical laws involving collision courses between objects moving at different speeds and the overcoming of inertia in at-rest bodies.

These and still further objects as shall hereinafter appear are readily fulfilled by the present invention in a remarkably unexpected manner as will be readily discerned from the following detailed description of an exemplary embodiment thereof especially when read in conjunction with the accompanying drawing in which like parts bear like numerals throughout the several views.

THE DRAWINGS

In the drawings:

FIG. 1 is an isometric view of an amusement device embodying the present invention;

FIG. 1A is a plan view of the target sub-assembly;

FIG. 2 is a cross-section taken on line 2—2 of FIG. 1;

FIG. 3 is a cross-section taken on line 3—3 of FIG. 2 illustrating one variant of delivering shooter balls to the shooter sub-assembly in accordance herewith;

FIG. 4 is a cross-section taken on line 4—4 of FIG. 2;

FIG. 5 is a cross-section taken on line 5—5 of FIG. 4 showing the ball lift in its locked position;

FIG. 6 is a cross-section taken on line 5—5 of FIG. 4 showing the ball lift in its unlocked position; and FIG. 7 is a sectional view of a mechanism for separating the shooter balls from the target balls means for delivering the target balls through the loading container to the rotating target carrier in accordance herewith.

DESCRIPTION OF THE PREFERRED EMBODIMENTS

Referring to the drawing and especially FIGS. 1 and 2 thereof, the amusement device 10 of the present invention comprises in combination support means 11 upon which is disposed an encased playing compartment 12 having a shooter sub-assembly 14 disposed adjacent one end thereof and a target sub-assembly 16 disposed adjacent the other end thereof.

Encased playing compartment 12 is defined by a base or playing surface 18 having an upstanding front wall 19 and an upstanding rear wall 20 which are interconnected by upstanding side walls 21, 22 and covered by a transparent plate 23.

Shooter sub-assembly 14, whether set up for use with a single shooter ball 26 or with a plurality of shooter balls 126, comprises a housing 27 having a central rod 28 axially disposed therealong and attached to handle means 29 at one end thereof and passes through and is secured to a nose piece 30 at the other end thereof. A compression spring 31 is circumscribed about rod 28 between the rear surface 32 of nose piece 30 and front wall 19 to forcibly return handle means 29 to its at-rest position after it has been drawn away from wall 19 and thereafter released. The force of spring 31 drives rod 28 and nose piece 30 forward into engagement with ball 26 and impells ball 26 along cylindrical shooter tube 33 toward target sub-assembly 16.

Target sub-assembly 16 comprises a rotatable circular disc 36 having a central opening 37 defined therethrough and coacting therewith to define annular shelf 38. A plurality of discrete openings 39 are cut axially through shelf 38 in spaced relationship to each other to seat a target object such as ball 40 therewithin.

A circular guard rail 41 is secured to surface 18 in substantial circumscription around disc 36 and provides an opening 42 in confrontation with shooter tube 33.

Concentric with and in circumscription about guard rail 41 and disc 36 is a rotatable annulus 43 having a plurality of rectangular obstacle members 44 mounted thereupon normal thereto and in spaced relationship to each other and defining a gap 45 therebetween.

A suitable variable speed electric motor 46 is mounted upon support means 11 in operative linked relationship to disc 36 and annulus 43 beneath surface 18 where in response to the operator's manipulation of motor control 47, the speed of motor 46, and hence the speed of rotation of disc 36 and annulus 43 is controlled. As shown in FIGS. 1 and 4, motor control 47 may be installed in front wall 19.

Suitable mechanical linkages such as sheeve 48 which is mounted upon the drive shaft 49 of motor 46 and drive belt 50 which is reeved about sheeve 48 and driving ring 51 which is integrally formed with disc 36 enable the rotation of drive shaft 49 to rotate disc 36 for reasons hereafter explained. A similar mechanical linkage is operatively disposed between motor 46 and annulus 43 and, in my preferred embodiment, will include a reversing member (not shown) so that disc 36 and annulus 43 may rotate in opposite directions.

An inverted truncated conical member 52 is mounted inside of annular shelf 38 to receive and collect all free moving balls therewithin and direct those balls through opening 53 defined therein for sorting and relocation as will be hereinafter described in detail.

A cobra head 54 or other suitable figurine may be mounted in juxtaposition to opening 53 to provide the allusion that the several balls are being swallowed up by the "monster" to add to the levity of the experience.

In one embodiment of my invention, the gap 45 between adjacent obstacle members 44 will be sufficient to allow shooter ball 26 to penetrate the gap 45 and dislodge target ball 40 from its seat 39 but not to pass through the gap 45. This is my so-called "single shooter version" and shooter ball 26 is returned to its armed position simply by rolling back down shooter tube 46, which slopes gently downwardly from target subassembly 16 to shooter subassembly 14.

In an alternative embodiment of my invention, the gap 45 between adjacent obstacle members will be sufficient to allow shooter ball 26 to pass therebetween and into collector 52.

When only target balls 40 are free within annular shelf 38, the collector 52 directs the targets balls 40 to target ball relocation means 56 to be described hereafter.

When both target balls 40 and shooter balls 26 (126) are free within the annular shelf 38, the collector 42 directs all of the balls to separator means 58 which segregates shooter balls 26 (126) from target balls 40 by virtue of their size and weight diffential, i.e., shooter balls 26 are preferably made of steel and have a diameter of about 13 mm whereas target balls 40 are preferably made of high impact plastic such as styrene and the like and will have a diameter of about 18–21 mm. Once separated by separator 58, target balls 40 are dircted to target ball relocation means 56 and shooter balls 26 are dropped into ball return ramp 59 where they roll down onto ball lift 60 from whence they can be deployed to the ready position as will be hereinafter described in detail.

As shown in FIG. 7, separator means 58 comprises a first chamber 61 disposed beneath in communicating relationship with conical collector 52 via opening 53 defined therein when the top of the inverted cone was truncated therefrom. An opening 62 is defined in the bottom of chamber 61 having an opening of not more than one-half inch, that is, sufficient to receive and pass therethrough a shooter ball 26 having a 13 mm diameter but insufficient to accept a target ball 40 having a diameter of at least 18 mm.

The shooter balls 26, upon passing through opening 62, are dropped onto ball return ramp 59 which directs the balls 26 to ball lift 60 as previously described.

Adjacent opening 62 in the side of chamber 61, is a lateral opening 63 leading to an inclined ramp 64 which directs target balls 40 for pickup by a suitable conveyor 65 having lifts 70 which pick up the target balls 40 and elevates the balls 40 for delivery into loading container 66 where the balls are retained until the game cycle is reinitiated.

A control for regulating non-compensatory use of the device will now be described, it being understood that any of several well known devices for assuring payment in the form of coins or tokens is made before the device can be used may be interchanged herewith without departing from the overall spirit of this disclosure.

Referring to FIGS. 3, 5 and 6, ball lift 60 comprises a platform, a lever arm which is pivotally attached at one end thereof to the platform by suitable fastening means and extends therefrom through a bracket means which is mounted on the inner surface of wall 19, through a vertical slot to a suitable handle means 72 disposed outside of compartment 12. A pivot pin extends through the bracket means and the lever arm and defines the fulcrum therefor.

An arm member is integrally formed with and telescopically extends from for operational response to solenoid 68 to retract the arm from its blocking arrangement across the lever arm of lift 70 when an appropriate coin is inserted into coin drop mechanism. After depositing the coin as described, the operator will depress the lift handle means thereby relocating the platform and the balls 26 resting thereupon to the ready position.

If preferred, the coin activated interlock can be interconnected with target ball relocation means 56 whereupon loading container 66 is "unlocked" in response to the deposit of the coin through the action of a similar solenoid 69. The coin interlock can also be tied into the operation of variable speed motor 46 to permit it to operate only after appropriate deposit is made to initiate power from power source 67 to motor 46.

A further variation of the present invention comprises the interconnection of a suitable timer between the source of electric power 67 and motor 46 which is especially well suited to the time limit method of comparative scoring.

Any reasonably sturdy material such as oak, steel, or high impact plastic can be used to construct support means 11 whereas furniture woods are preferred for playing compartment 12.

To play the device, a suitable coin is deposited and a shooter ball 26 is moved into its ready-to-fire position in front of nose piece 30. Annular shelf 38, having one of a plurality of target balls 40 seated in each opening 39, is rotating in one direction, for example, clockwise, while rotatable annulus 43 carrying a plurality of obstacles 44 is rotated in the opposite direction, e.g., counterclockwise. The speed of rotation, and hence the range of potential scoring, is established by adjusting motor control 47 and the operator observes the passing target balls 40 in the gaps 45 between obstacle members 44. When the player determines that he/she is about ready to shoot, he/she grasps handle 29 and pulls back on rod 28 to compress spring 31. When the propitious moment to fire is reached, the player releases handle 29 and the compressed spring 31, bearing upon wall 19, forces rod 28 rapidly forward and nose piece forcibly engages shooter ball 26 propelling it up shooter tube 33 and hopefully, through gap 45 into engagement with target ball 40 driving it from its seat 39 into the mouth of Cobra 54 into collector 52 and through opening 52.

Scoring is relative and is based upon the speed of rotation, for example, at a relatively slow speed, each target ball scored is worth ten (10) points but increases to twenty (20) points when an intermediate speed is chosen and is worth forty (40) points at the fastest speeds.

From the foregoing it becomes readily apparent that the amusement device herein described and illustrated fulfills all of the aforestated objectives in a remarkably unexpected fashion. It is of course understood that such modifications, alterations and adaptations as will readily occur to the artisan confronted with this disclosure are intended within the spirit of the present invention which is limited only by the scope of the claims appended hereto.

What is claimed is:

1. An amusement device comprising a base structure having a playing surface; a plurality of target objects; first rotating means mounted in said base structure and having a plurality of seats defined therein for receiving said target objects in an initial static position relative to said rotating means for rotation therewith; second rotating means disposed in rotatable circumscription about said first rotating means and supporting a plurality of barriers spaced on the periphery thereof defining a plurality of gaps therebetween; selective control means operatively associated with and controlling the direction and speed of said first and said second rotating means; a shooter ball; shooter means operatively disposed in spaced facing relationship to said rotating target objects and manually actuable to propel said shooter ball from an at rest position toward one of said rotating target objects to dislodge said object from its static position; collector means collecting said propelled shooter ball and said dislodged target object and returning them to their respective at rest positions; motor means for driving said rotating means; power means for energizing said motor means; and actuator means responsive to a deliberate external act to energize said motor means and place said target objects and said shooter ball in an at-play condition.

2. An amusement device according to claim 1 in which an upstanding wall member is disposed in circumscription about said first rotating means and has a window defined therein facing said shooter means to expose one of said rotating targets therethrough when one of said targets is aligned with one of said gaps defined by said rotating barriers.

3. An amusement device according to claim 2 having an enclosed motor tube operatively interposed between said shooter means and said window to direct said shooter ball toward said gap and return said shooter ball to its at rest position.

4. An amusement device according to claim 1 in which said first rotating means comprises a flat annular flange and said seats comprise a plurality of holes defined therein in equispaced relationship thereabout.

5. An amusement device according to claim 1 in which said collector means comprises an inverted truncated conical member operatively interposed within said first rotating means for receiving said target object when dislodged therefrom and delivering it for reinstatement in an initial static position thereupon.

6. An amusement device comprising a base structure having a playing surface; first rotating means mounted in said base structure and having a plurality of seats defined therein for receiving target objects in an initial static position relative to said rotating means for rotation therewith; second rotating means disposed in rotatable circumscription about said first rotating means and supporting a plurality of barriers spaced on the periphery thereof defining a plurality of gaps therebetween, each of said gaps being sufficiently small to permit the penetration but not the passage of a shooter ball therebetween; control means operatively associated with and controlling the direction and speed of said first and said second rotating means; shooter means disposed in spaced facing relationship to said rotating target objects and manually actuable to propel a shooter ball from an at rest position toward said gap to strike one of said target objects exposed therethrough; first collector means collecting a propelled shooter ball and returning it to its at rest position; second collector means collecting dislodged target objects and conveying them to a loading position; conveyor means for directing each target object from said loading position to a static position on said first rotating means; and actuator means responsive to a deliberate external act to place both said target objects and said shooter ball in an at play condition.

7. An amusement device according to claim 6 in which an upstanding wall member is disposed in circumscription about said first rotating means and has a window defined therein facing said shooter means to expose one of said rotating targets therethrough when one of said targets is aligned with one of said gaps defined by said rotating barriers.

8. An amusement device according to claim 7 having an enclosed shooter tube operatively interposed between said shooter means and said window to direct said shooter ball toward said gap and return said shooter ball to its at rest position.

9. An amusement device according to claim 6 in which said first rotating means comprises a flat annular flange and said seats comprise a plurality of holes defined therein in equispaced relationship thereabout.

10. An amusement device according to claim 9 in which said collector means comprises an inverted truncated conical member operatively interposed within said first rotating means for receiving said target object when dislodged therefrom and delivering it for reinstatement in an initial static position thereupon.

11. An amusement device comprising a base structure having a playing surface; a plurality of target balls; first rotating means mounted in said base structure and having a plurality of seats defined therein for receiving said target balls in an initial static position relative to said rotating means for rotation therewith; second rotating means disposed in rotatable circumscription about said first rotating means and supporting a plurality of barriers spaced on the periphery thereof defining a plurality of gaps therebetween; selective control means operatively associated with and controlling the direction and speed of said first and said second rotating means; a shooter ball; shooter means disposed in spaced facing relationship to said rotating target and manually actuable to propel said shooter ball from an at rest position through one of said gaps into collision with one of said rotating target balls to dislodge said target ball from said first rotating means; collector means collecting propelled shooter balls and dislodged target balls; separator means receiving said balls from said collector means and segregating said shooter balls from said target balls; channel means directing said shooter balls from said separator means to a first loading position; conveyor means directing said target balls from said separator means to a second loading position; delivery means for directing each said target ball from said second loading position to a static position on said first rotating means; motor means for driving said rotating means; power means for energizing said motor means; and actuator means responsive to a deliberate external act to transfer said target ball and said shooter ball from said loading positions to an at play position and energize said motor means.

12. An amusement device according to claim 11 in which an upstanding wall member is disposed in circumscription about said first rotating means and has a window defined therein facing said shooter means to expose one of said rotating targets therethrough when one of said targets is aligned with one of said gaps defined by said rotating barriers.

13. An amusement device according to claim 11 in which said first rotating means comprises a flat annular flange and said seats comprise a plurality of holes defined therein in equispaced relationship thereabout.

14. An amusement device according to claim 11 in which said control means rotates said first rotating means and said second rotating means in opposite directions of rotation.

15. An amusement device according to claim 14 in which said shooter balls and said target ball are of different weight and size.

16. An amusement device according to claim 1 in which each said target ball is formed of light weight shock resistant plastic and has a diameter of at least 18 mm.

17. An amusement device according to claim 1 in which each said shooter ball is formed of metal and has a diameter of not more than 13 mm.

* * * * *